US006383721B1

(12) United States Patent
Kamimura et al.

(10) Patent No.: US 6,383,721 B1
(45) Date of Patent: May 7, 2002

(54) MARKING METHOD AND MARKED RESIN MOLDED PIECE

(75) Inventors: Yoshihiko Kamimura; Hirofumi Kikuda, both of Tsuruga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/442,437

(22) Filed: Nov. 17, 1999

(30) Foreign Application Priority Data

Nov. 17, 1998 (JP) ..... 10-326371

(51) Int. Cl.[7] ..... B41M 5/00

(52) U.S. Cl. ..... 430/320; 430/346; 430/945; 264/482

(58) Field of Search ..... 430/346, 945, 430/320; 264/482

(56) References Cited

U.S. PATENT DOCUMENTS

| | | | |
|---|---|---|---|
| 4,307,047 | A | 12/1981 | Edinger et al. |
| 4,391,764 | A | 7/1983 | Edinger et al. |
| 4,578,329 | A | 3/1986 | Holsappel |
| 4,816,374 | A | 3/1989 | Lecomte |

FOREIGN PATENT DOCUMENTS

| | | | |
|---|---|---|---|
| EP | 0 841 186 | * | 5/1998 |
| EP | 0 841 187 | * | 5/1998 |
| JP | 60-4094 | | 1/1985 |
| JP | 61-11771 | | 4/1986 |
| JP | 62-59663 | | 12/1987 |
| JP | 1-267092 | | 10/1989 |

OTHER PUBLICATIONS

English language translation of DE 0 841 186, May 1998.*

* cited by examiner

*Primary Examiner*—John A. McPherson
(74) *Attorney, Agent, or Firm*—Ratner & Prestia

(57) ABSTRACT

Marks having clearly divided plural colors can be formed on a resin molded piece at low cost. A resin molded piece with marks having clearly divided plural colors is obtained. A resin molded piece is formed by combining plural base materials molded and processed by using a mixture of resins and fillers changing in different colors by irradiation with energy ray, and the surface of this resin molded piece is irradiated with energy ray to mark the irradiated positions with plural colors, and forming a marked resin molded piece. Preferably, the resin molded piece is a keytop of keyboard used in an electronic appliance.

25 Claims, 5 Drawing Sheets

MARKING METHOD AND MARKED RESIN MOLDED PIECE

FIELD OF THE INVENTION

The present invention relates to a marking method for displaying characters and graphic patterns on a resin molded piece by energy ray such as laser beam, and a marked resin molded piece.

PRIOR ART

Conventional marking method on resin molded pieces by laser beam are disclosed in Japanese Patent Publication No. 61-11771 and Japanese Patent Publication No. 62-59663. That is, a mixture is prepared by mixing a filler which changes color by action of laser beam in a resin of base material, and this mixture is molded into a resin molded piece by injection molding method or the like, and this molded piece is irradiated with laser beam to change the color of the filler. Such methods of marking desired characters and graphic patterns are disclosed. Other marking methods are disclosed in Japanese Laid-open Patent No. S60-4094 and Japanese Laid-open Patent No.H1-267092. That is, plural layers of coat films are formed by adhering plural paints having different colors preliminarily on the surface of resin molded piece, and the coat films are irradiated with laser beam, and coat films of only surface layer or plural layers are locally removed. Such methods of marking desired characters and graphic patterns are disclosed.

Such conventional marking methods and marked resin molded pieces are described by referring to FIG. 5 and FIG. 6.

FIG. 5 is a front view for explaining the method of changing the color of the filler in the resin molded piece. In FIG. 5, a laser beam 1 is controlled by a deflector 2. A resin molded piece 3 is a molded piece of a mixture of a resin and a filler 4 such as carbon black or dye□containing□silicon which changes color by the action of the laser beam 1. When the laser beam 1 is emitted to the resin molded piece 3 according to a desired character or graphic pattern, the filler 4 in the resin molded piece 3 changes color, and a mark 5 is formed on the surface layer of the resin molded piece 3, so that a marked resin molded piece is obtained.

FIG. 6 is a sectional view of essential parts for explaining a method of removing the coat film of the paint on the resin molded piece. In FIG. 6, a laser beam 1 is controlled by a deflector 2 same as in the case above. On the surface of the resin molded piece 6, three color paints are sequentially applied, and three layers of coat films 7, 8, 9 are formed. The laser beam 1 is deflected and controlled in the emitting position corresponding to a desired character or graphic pattern, and its energy quantity is controlled, and is emitted from the surface coat film 7 side of the resin molded piece 6. Depending on the energy quantity, the coat film 7, coat film 8 or coat film 9 is removed. Thus, a marked resin molded piece marked with character or graphic pattern of desired colors is obtained.

However, in the conventional marking method by making use of color change of the filler 4 of the resin molded piece 3 by laser beam 1, character or graphic pattern marks 5 of different colors cannot be formed on a same resin molded piece 3. Or in the method of removing the coat films locally by irradiating the surface of the resin molded piece 6 having coat films 7, 8, 9 with laser beam 1, by using different colors in the coat films 7, 8, 9, marking of combination of different color marks is possible, but it takes many steps on coating and drying, and the manufacturing cost is very high.

It is hence an object of the invention to present a marking method capable of marking various colors on a resin molded piece inexpensively, and a marked resin molded piece.

SUMMARY OF THE INVENTION

The invention is characterized by forming a resin molded piece by combining plural base materials molded and processed from a mixture of a resin and a filler which changes into different colors by irradiation with energy ray, irradiating the surface of the resin molded piece with energy ray, marking irradiated positions with plural colors, and forming a marked resin molded piece.

The marking method of the invention comprises:

(a) a step of forming a resin molded piece by using plural base materials, in which each one of the plural base materials is formed of a mixture of each filler and each resin, and each filler may be changed into mutually different color by irradiation with energy ray, and (b) a step of irradiating the resin molded piece with the energy ray, changing the color of the filler at the irradiated position, and forming each color mark, in which at least two of the different color marks are mutually different in color.

The marked resin molded piece of the invention comprises:

(a) a resin molded piece formed of plural base materials, in which each one of the plural base materials has each resin and each filler dispersed in each resin, and each filler may be changed into mutually different color by irradiation with energy ray, and (b) a color mark formed on the resin molded piece, in which the color mark has a mark changed by color change of each filler at the irradiated position of the energy ray, and at least two of the different color marks are mutually different in color.

Preferably, the resin molded piece is a keytop of a keyboard used in an electronic appliance.

In this constitution, marks having clearly divided plural colors can be formed on the resin molded piece at low cost.

REFERENCE NUMERALS

Figure 1:
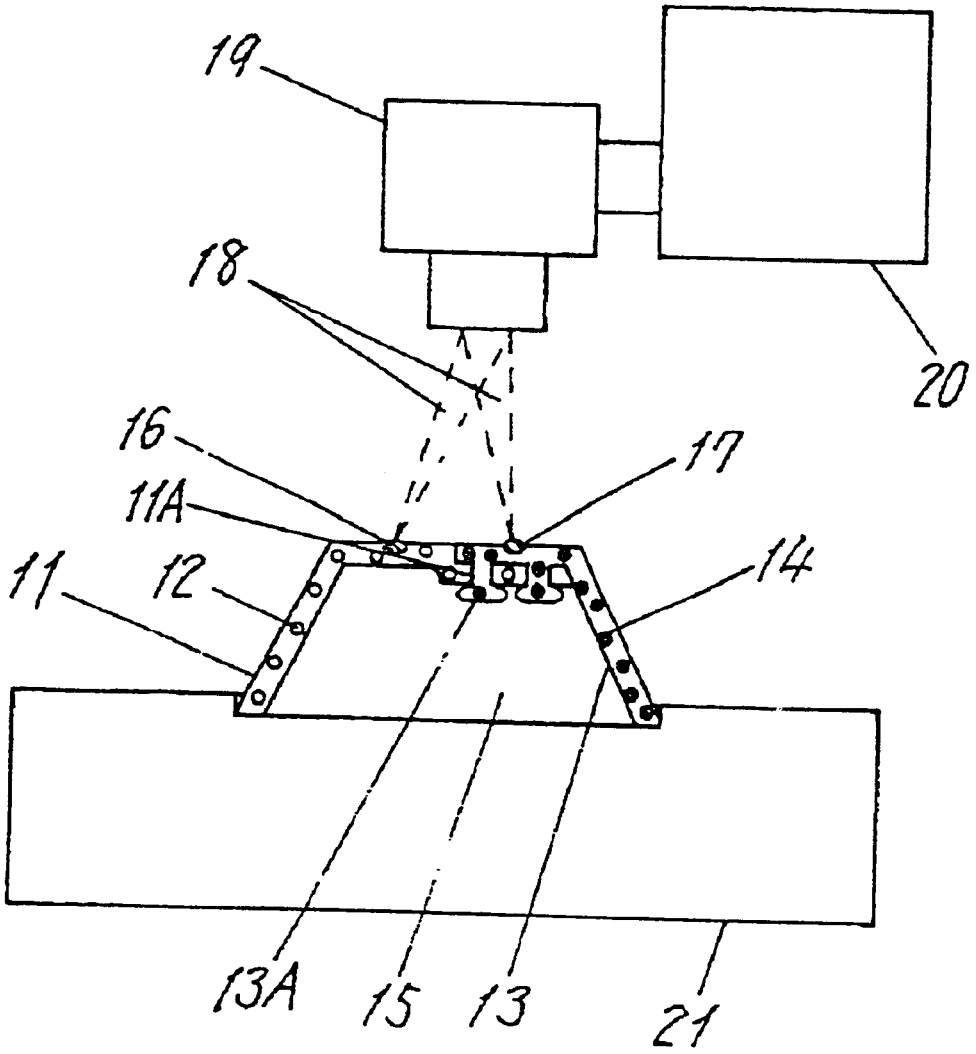
FIG. 1 is a front view for explaining a marking method on a resin molded piece according to an embodiment of the invention.

11, 13, 23, 28 41, 42 Base material
11A Hole
13A Boss
12, 14, 22, 24 Filler
15, 25, 43 Resin molded piece
16, 17, 26, 27, 27A, 32, 33, 34, 44, 45 Mark

18 Energy ray
19 Deflector
20 Energy ray source
21 Support stand
31 Keytop

DETAILED DESCRIPTION OF THE INVENTION

In a marking method in an embodiment of the invention, a first mixture of a resin and a first filler which changes in different colors by irradiation with energy ray is prepared, and a first base material is molded by using this first mixture. Similarly, a second mixture of a resin and a second filler which changes in different colors by irradiation with energy ray is prepared, and a second base material is molded by using this second mixture. As required, third base material, fourth base material, and further plural base materials are molded. By combining these base materials, a resin molded piece is obtained. The surface of the resin molded piece composed of plural base materials is irradiated with energy ray. By irradiation with energy ray, the fillers in the base materials change in color. By such color changes of the fillers, plural color marks are provided at the irradiated positions. Thus, marking of different colors can be easily formed. Therefore, clearly divided plural color marks can be formed on the resin molded piece at low cost.

In a marking method in other embodiment of the invention, different from the above embodiment, a resin molded piece is formed by molding plural bases having different fillers integrally in a die. By molding plural mixtures having different fillers integrally by injection molding method, the resin molded piece is formed. In this method, in a shorter manufacturing time and at a lower cost, a marked resin molded piece having plural color marks can be obtained.

In a marking method in a different embodiment of the invention, different from the above embodiments, YAG laser beam is emitted as the energy ray. Since the YAG laser beam has a short wavelength, the energy is concentrated on the surface layer of the resin molded piece. Accordingly, the filler is easily changed in color, and sharper and wear-resistant marks can be applied.

Preferably, the resins used in the plural mixtures are same materials. In this constitution, clearly divided plural color marks are formed on the resin molded piece of same color in appearance.

Preferably, the resins and resin molded pieces are made of thermoplastic resins. By using thermoplastic resins, desired plural colors and complicated shapes can be easily obtained. It means a large degree of freedom in selection of material for the resin molded piece.

By this marking method, clearly divided plural colors, and desired free characters and graphic patterns are easily formed, and marks with excellent wear resistance are formed, and moreover such marked resin molded pieces can be obtained at low cost.

More preferably, the resin molded piece is a keytop of a keyboard for an electronic appliance. The keytop has plural protrusions, and at least one mark selected from the group consisting of character, symbol, numeral, and graphic pattern is formed on each one of the plural protrusions, and at least two of the marks have different colors. By applying the marking method of the embodiment in manufacture of keytop of keyboard for electronic appliance, marks of high quality and excellent wear resistance having different marks and plural color marks can be easily and inexpensively formed on keytops of same shape.

Exemplary embodiments of the invention are described below by referring to FIG. 1, FIG. 2 and FIG. 3.

Exemplary Embodiment 1

FIG. 1 is a front view for explaining a marking method for marking a resin molded piece with plural colors in an embodiment of the invention. In FIG. 1, a first base material 11 is formed of a first mixture of a first filler 12 and a first resin. The first filler 12 changes in color when irradiated with energy ray. A second base material 13 is formed of a second mixture of a second filler 14 and a second resin. The second filler 14 changes in color when irradiated with energy ray. The first filler 12 and second filler 14 change in mutually different colors. A boss 13A provided in the bottom of the second base material 13 is inserted into a hole 11A in the bottom of the first base material 11, and when the tip of the boss 13A is fused or crimped, the first base material 11 and second base material 13 are combined side by side, and an integrated resin molded piece 15 is formed. The resin molded piece 15 may be also manufactured by combining the first base material 11 and second base material 13 without using the boss 13A.

When an energy ray 18 is emitted to the first filler 12, a first color mark 16 is formed. When an energy ray 18 is emitted to the second filler 14, a second color mark 17 is formed. The first color mark 16 and second color mark 17 are mutually different in color. The energy ray 18 is generated from an energy ray source 20, and a deflector 19 deflects and controls the irradiation state by the energy ray 18 according to NC data. The resin molded piece 15 is positioned and supported on a support stand 21.

In this constitution, the resin molded piece 15 is put and positioned on the support stand 21 beneath the deflector 19. Then the energy ray 18 emitted from the energy ray source 20 is deflected and controlled by the deflector 19 according to the NC data. The energy ray 18 deflected and controlled according to the NC data is emitted to the surface of the resin molded piece 15 at a specified intensity by scanning a specified mark such as character, numeral or pattern according to the NC data. Coinciding with the emitted scanning profile, the first filler 12 in the first base material 11 changes color and a first color mark 16 is formed. Similarly, the second filler 14 of the second base material 13 at the irradiated position changes color to form a second color mark 17. Thus, the first color mark 16 and second color mark 17 are formed at the same time. Thus, the specified mark is formed at the irradiated position. In this way, the resin molded piece having clearly divided plural color marks are formed at low cost.

The first filler 12 and second filler 14 changing in color by irradiation with the energy ray 18 are not particularly specified, but usable examples include carbon black and graphite which are gasified by irradiation with laser beam, and dye, inorganic compounds containing silicon and dye containing silicon which are decomposed by irradiation with laser beam.

These fillers are dispersed and mixed in the resin. Accordingly, when energy ray is emitted, these fillers are discolored or decomposed near the surface in the resin. Therefore, if the user touches the colored marks repeatedly, the marks are not erased. That is, the formed marks are excellent in wear resistance.

It is preferred to use YAG laser beam as the energy ray 18. Since the YAG laser beam has a short wavelength, the energy is concentrated on the surface layer of the resin molded piece 15. Therefore, the first filler 12 and second filler 14 are easily discolored. At the same time, sharper and excellent wear-resistant marks are formed.

In the embodiment, two kinds of fillers and base materials are used for the first base material 11 having the first filler 12 and the second base material 13 having the second filler 14, but not limited to this constitution, plural color marks can be also formed by using a resin molded piece combining plural base materials such as other base materials containing other fillers.

The first resin and second resin may be made of either same resins or different types of resins. As these resins, thermoplastic resins, thermosetting resins, and other arbitrary resins can be used. In these mixtures, ordinary additives such as pigment, dye, reinforcing agent or plasticizer may be also contained.

Exemplary Embodiment 2

Figure 2:
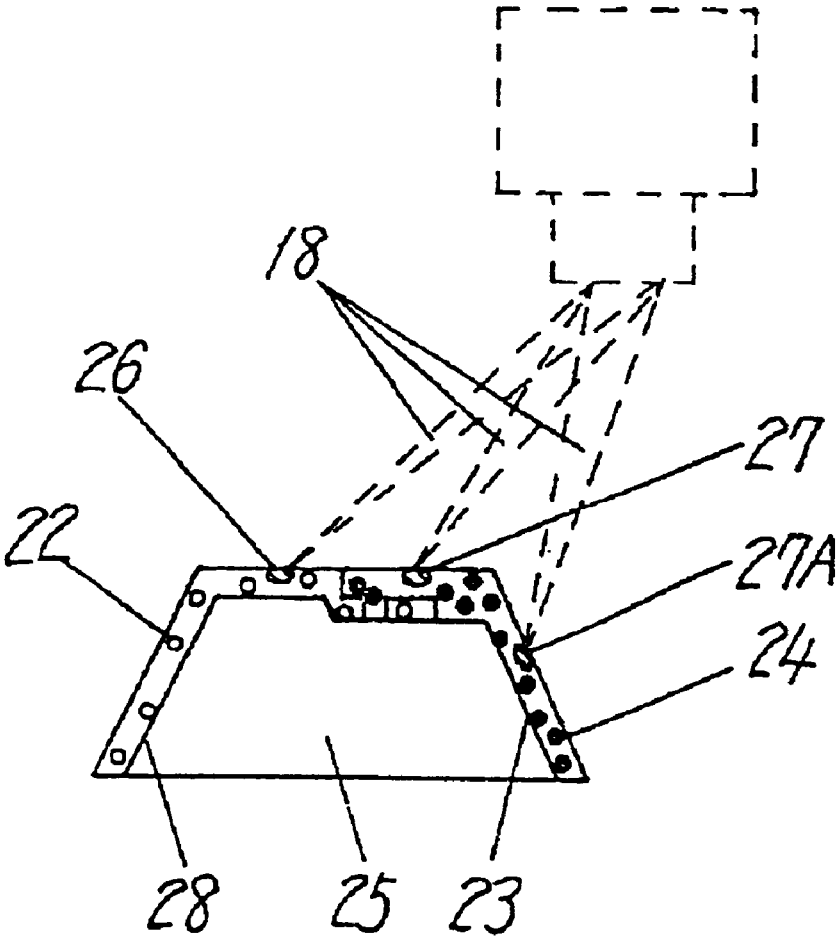
FIG. 2 is a sectional view of essential parts of the resin molded piece shown in FIG. 1.
Figure 3:
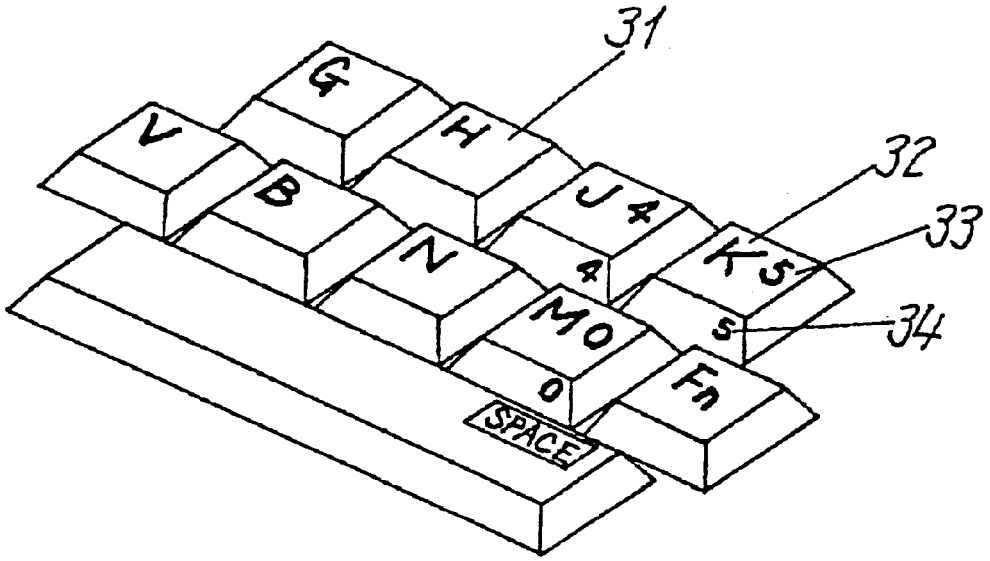
FIG. 3 is a partial perspective view of a keyboard shown in FIG. 1.

FIG. 2 is a front view for explaining a marking method for marking a resin molded piece with plural colors in other embodiment of the invention. In FIG. 2, a third base material 28 is formed of a third mixture of a third filler 22 and a third resin. The third filler 22 changes in color when irradiated with energy ray. A fourth base material 23 is formed of a fourth mixture of a fourth filler 24 and a fourth resin. The fourth filler 24 changes in color when irradiated with energy ray. The third filler 22 and fourth filler 24 change in mutually different colors. By molding the third mixture and fourth mixture integrally in a die, a resin molded piece 25 having the third base material 28 and fourth base material 23 side by side is formed. That is, the resin molded piece 25 is formed of the third mixture and fourth mixture by two-material molding method or the like. The surface of the resin molded piece 25 is irradiated with an energy ray 18. By this irradiation, the third filler 22 is discolored to form a third color mark 26, and the fourth filler 24 is discolored to form fourth color marks 27, 27A. This method does not require the joining step of the third base material 28 and fourth base material 23 by fusing or crimping. Accordingly, the marked resin molded piece is obtained in a short manufacturing time and at a low cost.

The third resin and fourth resin may be made of either same resins or different types of resins. In these mixtures, ordinary additives such as pigment, dye, reinforcing agent or plasticizer may be also contained. The third filler 22 and fourth filler 24 change into mutually different colors, so that marks clearly divided by these two colors can be formed. As these resins, thermoplastic resins, thermosetting resins, and other arbitrary resins can be used. In particular, when thermoplastic resins such as acrylonitrile butadiene styrene resin (ABS) and polyacetal resin are used, the degree of freedom of selection of resin molded piece is wider, and marked resin molded pieces of plural colors and complicated shapes can be obtained easily.

Exemplary Embodiment 3

Preferably, the resin molded piece of the invention is used in a keyboard for an electronic appliance. FIG. 3 is a partial perspective view of a keyboard as input means for an electronic appliance. In FIG. 3, the keyboard comprises plural keytops 31, fifth color mark 32, sixth color mark 33, and seventh color mark 34. The plural keytops 31 are made of a thermoplastic resin. The fifth color mark 32 and sixth color marks 33 are formed on the top face of specific keytops of the plural keytops 31. The seventh color mark 34 is formed on specific side faces of the plural keytops 31. At least two of the fifth color mark 32, sixth color mark 33, and seventh color mark 34 are marks of mutually different colors, patterns, or shapes.

A manufacturing method of the keyboard having the fifth color mark 32, sixth color mark 33, and seventh color mark 34 is explained below. Using a fifth mixture having the fifth filler and fifth resin, and a sixth mixture having the sixth filler and sixth resin, a keyboard molded piece having plural keytops 31 as shown in FIG. 3 is formed integrally. The keyboard molded piece is irradiated with laser beam deflected and controlled by the NC data of the deflector 19. The fillers are discolored at the laser beam irradiated positions, and specific marks (for example, characters, numerals and symbols such as G, H, J4, K5, 4, 5, SPACE as shown in FIG. 3) are formed.

For example, when carbon black powder is used as the fifth filler, a black character is formed as the fifth color mark. When a blue pigment is used as the sixth filler, a blue numeral is formed. Thus, according to the method of the embodiment, plural color marks are formed on the keytops of the keyboard. Clearly divided different color marks are manufactured sharply and inexpensively at high quality. Even in the case of the molded resin repeatedly touched by the user such as keytops, the formed marks are not erased, and an excellent wear resistance is realized.

Exemplary Embodiment 4

Figure 4:
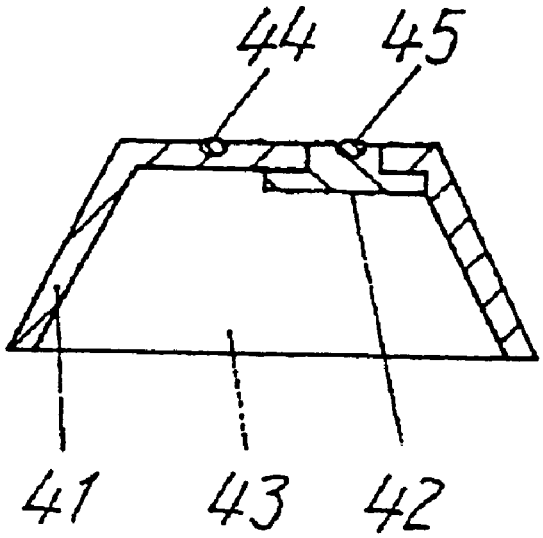
FIG. 4 is a sectional view of the resin molded piece shown in FIG. 1.
Figure 5:
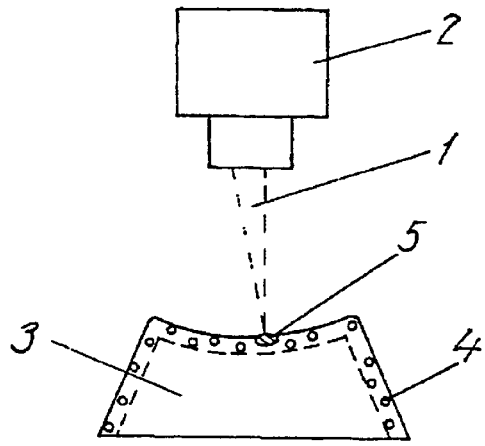
Fig. 5 PRIOR ART
FIG. 5 is a front view for explaining a conventional marked resin molded piece.
Figure 6:
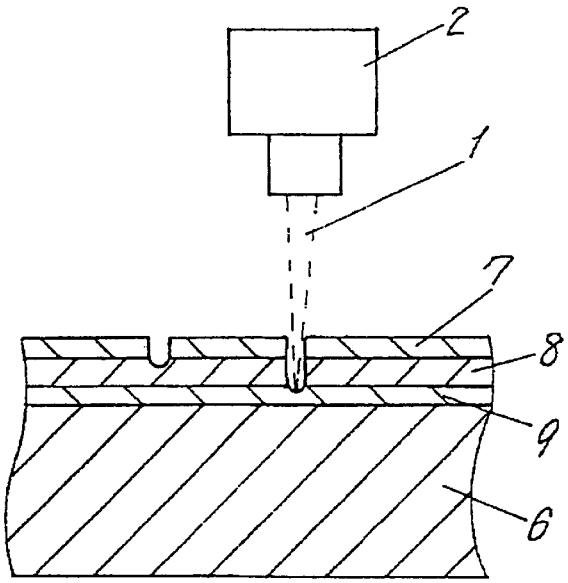
Fig. 6 PRIOR ART
FIG. 6 is an essential sectional view showing a marking method by other conventional method.

In the foregoing embodiments, two base materials are combined side by side to compose a resin molded piece, but not limited to this, for example, the resin molded piece as shown in FIG. 4 may be also used. FIG. 4 is a sectional view of a resin molded piece having plural color marks in a different embodiment of the invention. In FIG. 4, a resin molded piece 43 comprises a seventh base material 41 having a seventh filler and a seventh resin, and an eighth base material 42 having an eighth filler and an eighth resin, which are combined into a specified shape. For example, in FIG. 4, the eighth base material 42 is composed inside of the seventh base material 41 by two-material molding method or ultrasonic fusion. The seventh base material 41 and eighth base material 42 have mutually different colors and mutually different materials. The seventh base material 41 and eighth base material 42 are discolored when irradiated by energy ray, and a seventh color mark 44 and an eighth color mark 45 are formed. The seventh color mark 44 and eighth color mark 45 are mutually different colors, characters, symbols or numerals. Thus, a marked resin molded piece combining various patterns and colors can be obtained.

Thus, according to the invention, marks having clearly divided plural colors can be formed on a resin molded piece at low cost. A resin molded piece marked with clearly divided plural colors can be also obtained.

What is claimed is:

1. A marking method comprising the steps of:

(a) forming a plurality of base materials, each base material being formed from a respective filler and resin, each filler changeable into respectively different colors by irradiation with energy rays, (b) combining said base materials after said base materials are molded, to obtain a resin molded piece; and (c) irradiating said resin molded piece with said energy ray, to obtain said respectively different colors.

2. The marking method of claim 1, wherein said energy ray is a YAG laser beam.

3. The marking method of claim 1, wherein said each resin is mutually same material.

4. The marking method of claim 1, wherein said resin molded piece is made of a thermoplastic resin.

5. The marking method of claim 1, wherein said resin molded piece is a keytop of keyboard used in an electronic appliance.

6. The marking method of claim 1, wherein at said step (c), said energy ray scans as being deflected and controlled according to NC data.

7. The marking method of claim 1, wherein said filler contains at least one selected from the group consisting of carbon black, graphite, dye, inorganic compounds containing silicon and dye containing silicon.

8. The marking method of claim 1, wherein said color mark is at least one selected from the group consisting of character, symbol, numeral, and graphic pattern.

9. A marked resin molded piece having marks formed on a surface thereof, according to the making method of claim 1.

10. A marked resin molded piece having marks formed on a surface thereof, according to the making method of claim 1, wherein said resin molded piece is a keytop of keyboard used in an electronic appliance.

11. The marking method of claim 1, wherein said (b) step of combining said resin molded piece includes the step of combining said plurality of base materials by at least one of fusing and crimping of a boss.

12. A marked resin molded piece comprising:

(a) a resin molded piece including a plurality of base materials, each of said plurality of base materials being molded and thereafter mutually combined, said each base material having each resin and each filler dispersed in each resin, and (b) each color mark formed on a surface of said each base material of said resin molded piece, said each color mark having each mark changed by color change of said each filler at an irradiated position of an energy ray, at least two of said each color mark being mutually different in color.

13. The marked resin molded piece of claim 12, wherein said resin molded piece is an assembly of said plurality of base materials.

14. The marked resin molded piece of claim 12, wherein said resin molded piece is a molded piece of thermoplastic resin.

15. The marked resin molded piece of claim 12, wherein said each resin is mutually same material.

16. The marked resin molded piece of claim 12, wherein said resin molded piece is a keytop of keyboard used in an electronic appliance.

17. The marked resin molded piece of claim 12, wherein said resin molded piece is a keytop of keyboard used in an electronic appliance, said keytop has a plurality of protrusions, and at least one mark selected from the group consisting of character, symbol and numeral is formed on each one of said plural protrusions, and at least two of said marks are mutually different in color.

18. The marked resin molded piece of claim 12, wherein said filler contains at least one selected from the group consisting of carbon black, graphite, dye, inorganic compounds containing silicon and dye containing silicon.

19. The marked resin molded piece of claim 12, wherein said color mark is at least one selected from the group consisting of character, symbol, numeral, and graphic pattern.

20. The marked resin molded piece of claim 12, wherein said energy ray is a YAG laser beam.

21. A marking method comprising the steps of:

(a) preparing a first mixture containing a first filler and a first resin, (b) preparing a second mixture containing a second filler and a second resin, (c) forming a first base material by molding said first mixture, (d) forming a second base material by molding said second mixture, (e) forming a resin molded piece by combining said first base material and said second base material after said base materials are molded; and (f) irradiating energy ray to said resin molded piece, forming a first color mark by changing a color of said first filler to a first color at irradiated position, and forming a second color mark by changing a color of said second filler to a second color at irradiated position, said first color and said second color being mutually different.

22. The marking method of claim 21, further comprising the steps of:

(g) preparing a plurality of mixture containing each filler and each resin, and (h) forming a plurality of base material by molding said each mixture, wherein said (e) step includes the step of forming said resin molded piece by combining said first base material, said second base material, and said plurality of base material, said (f) step includes the step of changing a color of said each filler at an irradiated position, and forming each color mark.

23. The marking method of claim 21, wherein said energy ray is a YAG laser beam, said filler is capable to change color by irradiation with said energy ray.

24. The marking method of claim 21, wherein said filler contains at least one selected from the group consisting of carbon black, graphite, dye, inorganic compounds containing silicon and dye containing silicon.

25. The marking method of claim 21, wherein said molded piece is a key top of a keyboard used in an electronic appliance.

* * * * *